United States Patent [19]

Dix

[11] Patent Number: 4,492,144

[45] Date of Patent: Jan. 8, 1985

[54] TRANSPORT MECHANISM FOR AMMUNITION

[75] Inventor: Joseph Dix, Williston, Vt.

[73] Assignee: General Electric Co., Burlington, Vt.

[21] Appl. No.: 365,727

[22] Filed: Apr. 5, 1982

[51] Int. Cl.[3] ..... F41D 10/02

[52] U.S. Cl. ..... 89/33.17; 89/34; 89/33.14

[58] Field of Search ..... 89/33 D, 33 B, 33 BA, 89/33 BB, 33 BC, 33 CA, 36 K, 36 H, 34, 46

[56] References Cited

U.S. PATENT DOCUMENTS

| | | | |
|---|---|---|---|
| 2,910,917 | 11/1959 | Herlach et al. | 89/33 B |
| 3,427,923 | 2/1969 | Meyer et al. | 89/34 X |
| 3,498,178 | 3/1970 | Meyer et al. | 89/34 |
| 3,696,704 | 10/1972 | Backus et al. | 89/34 |
| 3,974,738 | 8/1976 | Meyer | 89/34 |
| 4,127,055 | 11/1978 | Hottinger et al. | 89/33 B X |

FOREIGN PATENT DOCUMENTS

| | | | |
|---|---|---|---|
| 716181 | 10/1966 | Italy | 89/33 BA |

*Primary Examiner*—Harold J. Tudor
*Assistant Examiner*—Ted L. Parr
*Attorney, Agent, or Firm*—Bailin L. Kuch

[57] ABSTRACT

This invention provides a slip ring for the transport of linkless ammunition and fired cases between a supply means which is stationary with respect to a support and a gun which is journaled for rotation about an axis with respect to said support, comprising: a first transport means which is stationary with respect to said support and is adapted to be driven by the gun; a second transport means which is journaled for rotation about said axis with said support, and a differential means disposed between said first and second transport means and journaled for rotation about said axis with respect to said first and second transport means, said differential means including a plurality of compartments, each for receiving a respective round or case, said first and second transport means each respectively inserting into, or extracting rounds or cases from, said compartments, said first transport means directly coupled to and driving said differential means which is directly coupled to and drives said second transport means.

8 Claims, 7 Drawing Figures

TRANSPORT MECHANISM FOR AMMUNITION

BACKGROUND OF THE INVENTION

1. Field of the Invention

This invention relates to systems for transporting ammunition from a relatively fixed supply to a gun having one or more degrees of freedom of movement; for example, from a drum storage system through a conveyor system to a gun which may be moved in train, elevation and zenith (cross-elevation), and for returning empty cases to the supply.

2. Prior Art

The transport of ammunition from a relatively fixed supply to a gun in a turret is complicated by the fact that the gun moves in train and in elevation, and in some systems also moves in zenith or cross-elevation. Flexible chuting is conventionally utilized to guide and to transport the ammunition. Such an overall arrangement is shown, for example, in U.S. Pat. No. 3,911,787 issued Oct. 14, 1975 to C. M. Seibel, wherein the ammunition supply might be the flat, linear linkless system shown in U.S. Pat. No. 3,881,395 issued May 6, 1975 to T. W. Cozzi et el. Another ammunition supply might be the drum linkless system shown in U.S. Pat. No. 3,696,704 issued Oct. 10, 1972 to L. F. Backus et al, or one of the prior art drums discussed therein; or in U.S. Pat. No. 3,766,823 issued Oct. 23, 1973 to L. R. Folsom et al. Linked ammunition supply systems are disclosed in U.S. Pat. No. 3,427,923 issued Feb. 18, 1969 to E. A. Meyer et al; U.S. Pat. No. 3,498,178 issued Mar. 3, 1970 to E. A. Meyer et al; and U.S. Pat. No. 3,590,684 issued July 6, 1971 to K. J. Gilbert.

A unidirectional mechanism for accommodating the output rate of the ammunition supply system to the demand rate of the gun system is shown in U.S. Pat. No. 3,974,738 issued to E. A. Meyer on Aug. 17, 1976. That system requires a complex servo system with separate sets of drives, sensors and controls for the gun, the turret and the ammunition supply respectively, and is only capable of processing a single train of ammunition in a single direction, that is, all cartridge cases after firing must be ejected from the system-they cannot be returned to the ammunition supply.

SUMMARY OF THE INVENTION

An object of this invention is to provide a means for providing a train of articles, such as ammunition, between two points, which points may have relative mutual rotation about a common axis.

Another object is to provide such a means wherein one of said points may rotate more than 360° clockwise or counterclockwise with respect to the other of said points.

Yet another object is to provide such a means which concurrently provides two oppositely directed trains of articles.

Still another object is to provide a true differential conveyor system which sums two inputs consisting of gun firing rotation and turret rotation and which directs the ammunition storage container to feed or receive ammunition as required.

A feature of this invention is the provision of a slip ring for the transport of ammunition, which slip ring is concentric with an axis of rotation of a gun turret, comprising a stationary transport means, a rotatable transport means and a differential means.

BRIEF DESCRIPTION OF THE DRAWING

These and other objects, features and advantages of the invention will be apparent from the following specifications thereof taken in conjunction with the accompanying drawing in which.

DESCRIPTION OF THE INVENTION

Figure 1:
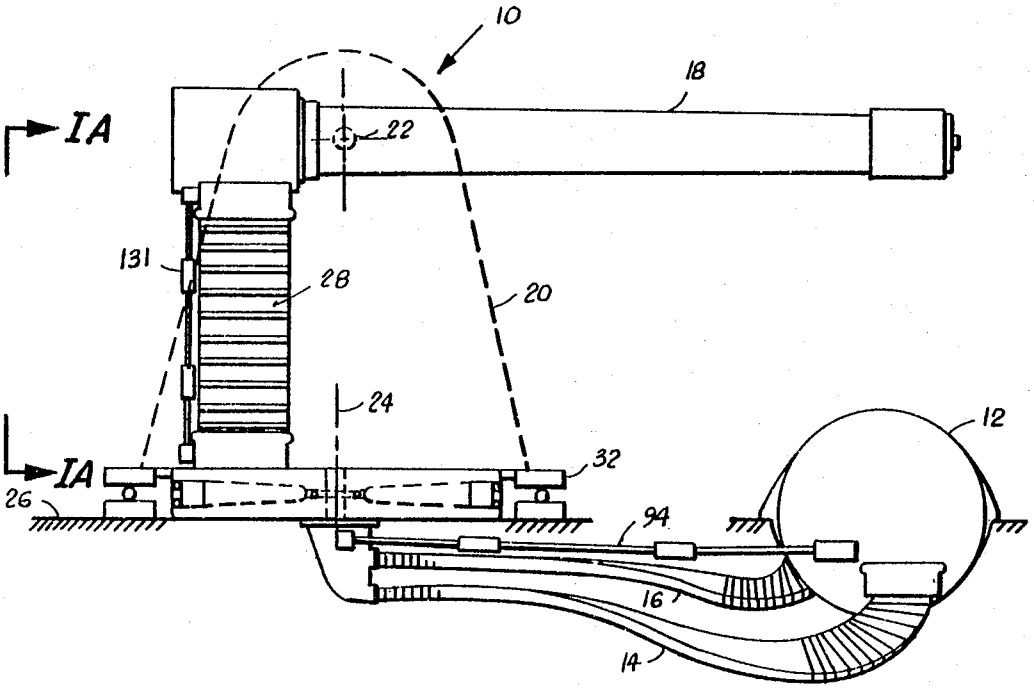
FIG. 1 is a schematic view in elevation of a turret having a single layer slip ring embodying this invention journaled for rotation about the azimuth axis of the turret.
Figure 1A:
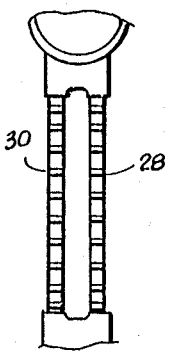
FIG. 1A is an end view of a portion of FIG. 1, showing that the device accommodates ammunition flow in two directions (i.e. to and from the gun)

FIG. 1 shows a turret which has almost full rotation in azimuth and limited rotation in elevation. Ammunition is provided to the turret by a conventional, double ended drum storage system 12 by means of a live round feed conveyor run 14 and a fired cartridge case return conveyor run 16. A gun 18 is jornaled to a pedestal 20 for limited movement about an elevation axis 22. The pedestal is journaled for rotation about an azimuth axis 24 to a stationary deck 26 by suitable means, not shown, which may be of the type shown by L. F. Backus et al in U.S. Pat. No. 3,995,509, issued Dec. 7, 1976. Ammunition is provided to the gun by means of a live round feed conveyor run 28 and a fired cartridge case return conveyor run 30 having a common turn-around sprocket which is driven by the feeder of the gun. These conveyors should be of the flexible kind, as shown, for example, by V. R. Gardy et al in U.S. Pat. No. 3,983,990, issued Oct. 5, 1976. The two conveyors are intercoupled by a slip ring 32.

Figure 2:
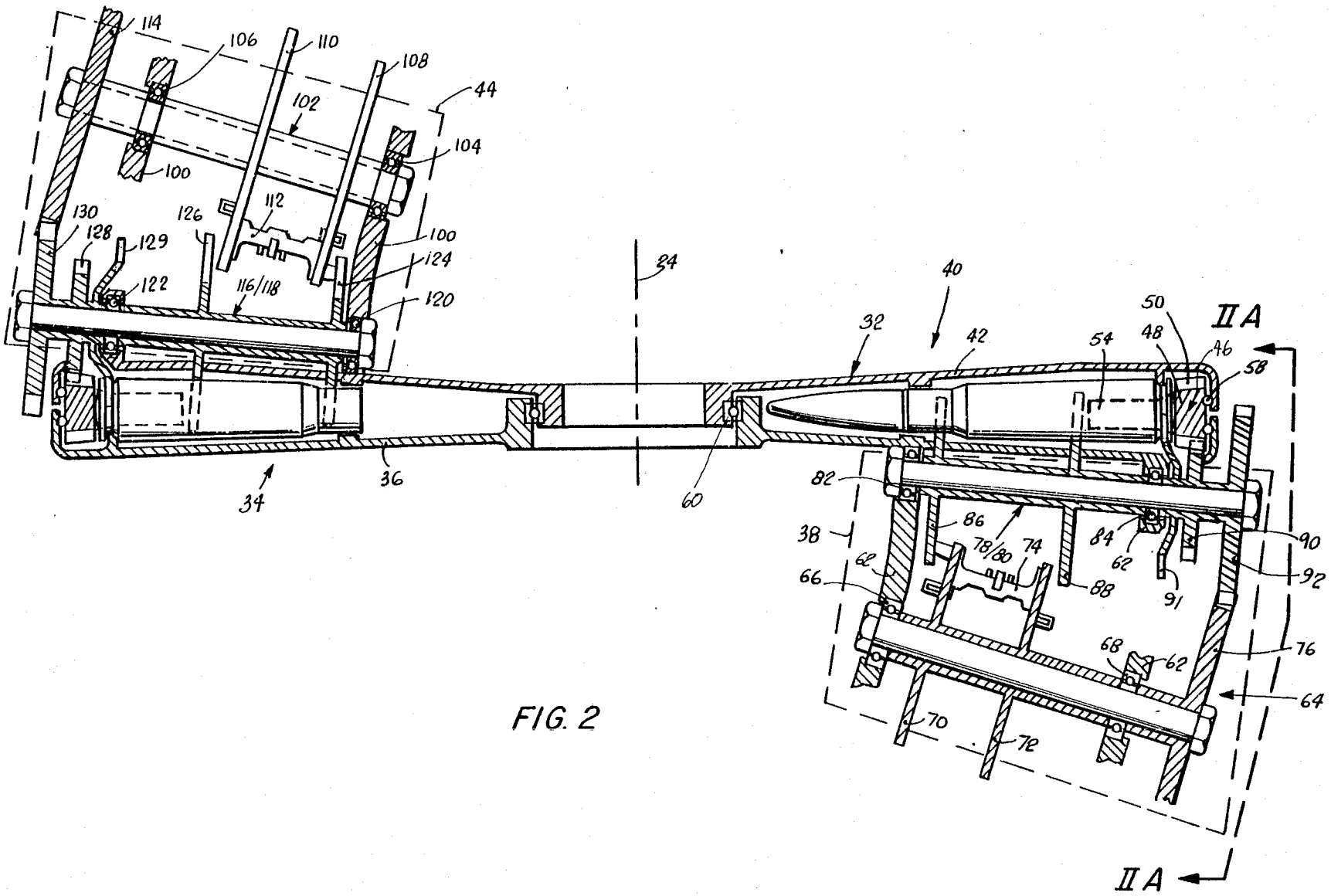
FIG. 2 is a view in elevation, taken in cross-section, of the slip ring of FIG. 1.

The slip ring 32, as shown in FIG. 2, comprises a stationary lower group 34, including a lower cover 36 which is fixed relative to the deck, and a lower transfer unit 38; a rotating upper group 40, including an upper cover 42 which rotates in conjunction with the pedestal about the azimuth axis 24, and an upper transfer unit 44; and a differential group 46 which rotates with respect to both covers.

The differential group comprises a retainer ring 48 having an upper face gear 50, a lower face gear 52, and a plurality of inwardly directed arms 54, with mutually adjacent pairs of arms defining a compartment 55 for receiving a round of ammunition. The rounds are disposed in their respective compartments in a circular row, with the projectiles proximal to the axis of rotation and the bases distal. Thus, the linear velocity of the bases is much faster than that of the projectiles. An outer, lower plurality of balls 56 journals the retainer ring 48 to the lower, stationary cover 36, and an outer, upper plurality of balls 58 journals the retainer ring to the upper, rotating cover 42. The upper cover is journaled to the lower cover by bearing 60.

The lower transfer unit 38 comprises a housing 62 in which a turn-around conical sprocket 64 is journaled by an inner bearing 66 and an outer bearing 68. The sprocket includes a pair of spaced apart sprocket disks 70 and 72 which are cut out to receive the train of conveyor elements 74 which forms an endless conveyor for ammunition and passes through the conveyor runs 14 and 16 (FIG. 1). The sprocket also has an outer gear 76. Two similar hand-off conical sprockets 78 and 80 are also journaled in the housing 62. Each sprocket, respectively, has an inner bearing 82, an outer bearing 84, a pair of spaced apart sprocket disks 86 and 88 which are cut out to receive the cartridge case of a round of ammunition from the turn-around sprocket 64, an intermediate gear 90, and an outer gear 92. The gear 90 includes a sprocket disk 91 which engages the extractor groove of the cartridge case. The orientation of the axes and the conical proportions of the sprockets are arranged so that the rounds in the hand-off sprockets have the same linear velocities as the rounds in the compartments. The gear 90 meshes with the lower face gear 52 of the retainer ring 48. The gear 92 meshes with the gear 76 of the turn-around sprocket wheel 64. Thus, there is a direct-drive-connection along the endless ammunition conveyor formed by element 74 which runs from the retainer ring 48, the hand-off sprocket wheel 78, the turn-around sprocket 64, and the ammunition supply 12 (FIG. 1), so that movement of any one causes synchronous movement of the others. A flexible drive shaft 94 may be connected in parallel with the endless conveyor to and between the group including gears 76, 92, 90 and 52, and the ammunition supply 12, to reduce the load needed to be transmitted by the endless conveyor.

The upper transfer unit 44 is similar to the lower transfer unit 38 and comprises a housing 100 in which a turn-around conical sprocket 102 is journaled by an inner bearing 104 and an outer bearing 106. The sprocket includes a pair of spaced apart sprocket disks 108 and 110 which are cut out to receive the train of conveyor elements 112 which forms an endless conveyor for ammunition and passes through the conveyor runs 28 and 30 (FIG. 1). The sprocket also has an outer gear 114. Two similar hand-off conical sprockets 116 and 118 are also journaled in the housing. Each sprocket has an inner bearing 120, an outer bearing 112, a pair of spaced apart sprocket disks 124 and 126 which are cut out to receive the cartridge case of a round of ammunition from the turn-around sprocket wheel 102, an intermediate gear 128, and an outer gear 130. The gear 128 meshes with the upper face gear 50 of the retainer ring 48. The gear 128 includes a sprocket disk 129 which engages the extractor groove of the cartridge case. The gear 130 meshes with the gear 114 of the turn-around sprocket wheel 102. Thus, there is a direct-drive-connection along the endless ammunition conveyor formed by the elements 112 which runs from the feeder of the gun 18, the turn-around sprocket wheel 102, the hand-off sprocket wheels 116 and 118, and the differential annulus 48, so that movement of any one causes synchronous movement of the others. A flexible drive shaft 131 may be connected in paralled with the endless conveyor to and between the group including gears 50, 128, 130 and 114, and the endless conveyor, and the feeder of the gun, to reduce the load needed to be transmitted by the endless conveyor.

Figure 2A:
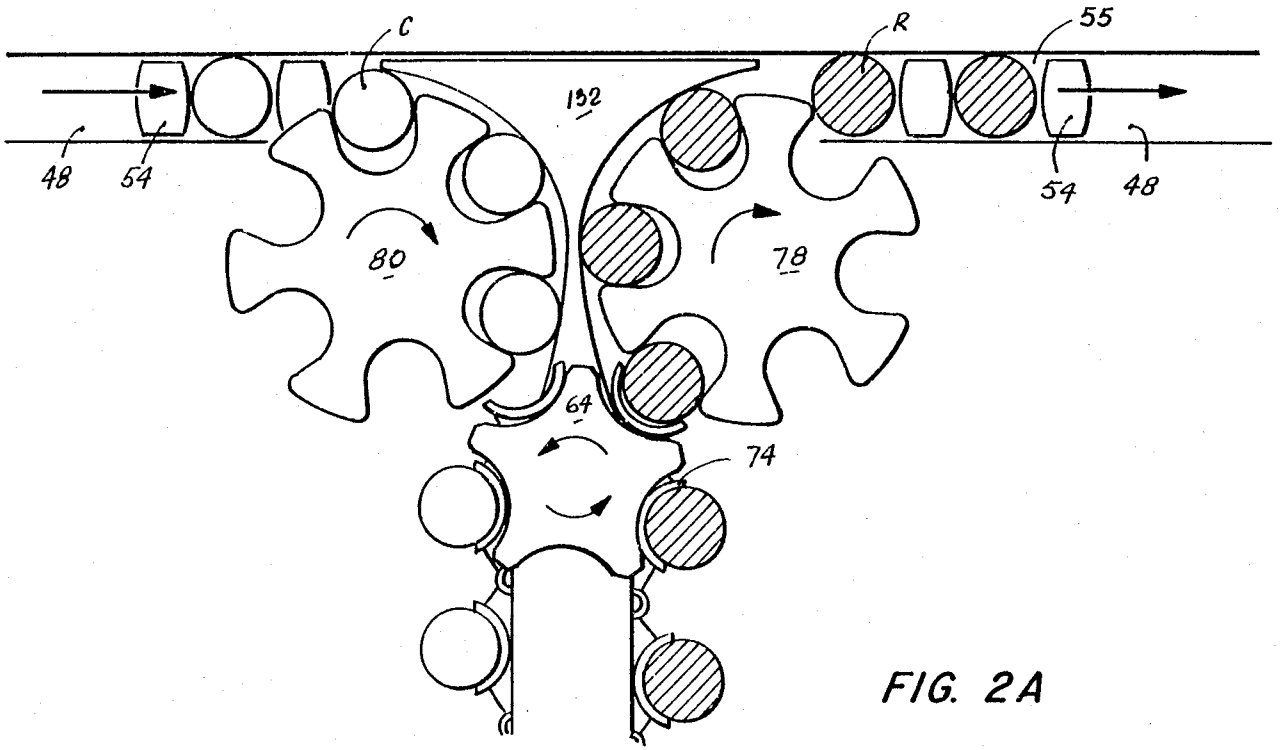
FIG. 2A is a schematic flat pattern view in elevation, taken along plane IIA—IIA of FIG. 2.

As shown in FIG. 2A, a suitable, conventional guide 132 is provided in the housing 62 in conjunction with the hand-off sprockets 78 and 80 to permit stripping of a round R from the conveyor element 74 at the turn-around sprocket 64 by one hand-off sprocket wheel 78 and its subsequent insertion into a compartment in the retainer ring 48. A similar guide is provided in the housing 100.

It will be seen that rounds R are fed into the compartments of the retainer ring 48 by the hand-off sprocket 78 and that fired cases C are extracted from the compartments by the hand-off sprocket 80. Similarly, rounds R are extracted from the compartments by the hand-off sprocket 116 and fired cases C are fed into the compartments by the hand-off sprocket 118. The upper group 40, including the housing 100 and the sprockets 116 and 118, is free to rotate with respect to the lower group 34 from a disposition whereat the sprockets 116 and 118 are at one side of the sprockets 78 and 80 through approximately 340° to a disposition whereat the sprockets 116 and 118 are at the other side of the sprockets 78 and 80.

When the upper and lower groups are mutually stationary, and the gun is firing, the retainer ring 48 rotates at a rate driven by the feeder of the gun, the endless upper conveyor of elements 112, the turn-around sprocket gear 114, the gear 130, the gear 128 and the gear 50. The retainer ring 48 drives the endless lower conveyor of elements 74 through the gears 52, 90, 92 and 76.

When the upper group rotates about the axis 24 relative to the lower group, and the gun is not firing, the endless upper conveyor of elements 112 does not advance, but causes the retainer ring 48 to rotate and through the gears 52, 90, 92 and 76 to drive the endless lower conveyor of elements 74 in either one direction or the other depending on which direction the upper group and the retainer ring are rotating.

When the upper group rotates and the gun is firing, the endless upper conveyor of elements 112 is driven by the feeder of the gun and causes the retainer ring to rotate in either one or the other direction at a rate which is either the sum or the difference of the rate caused by the rotation about the axis and the rate caused by the drive of the endless upper conveyor, depending on which direction the upper group is rotating.

Figure 3:
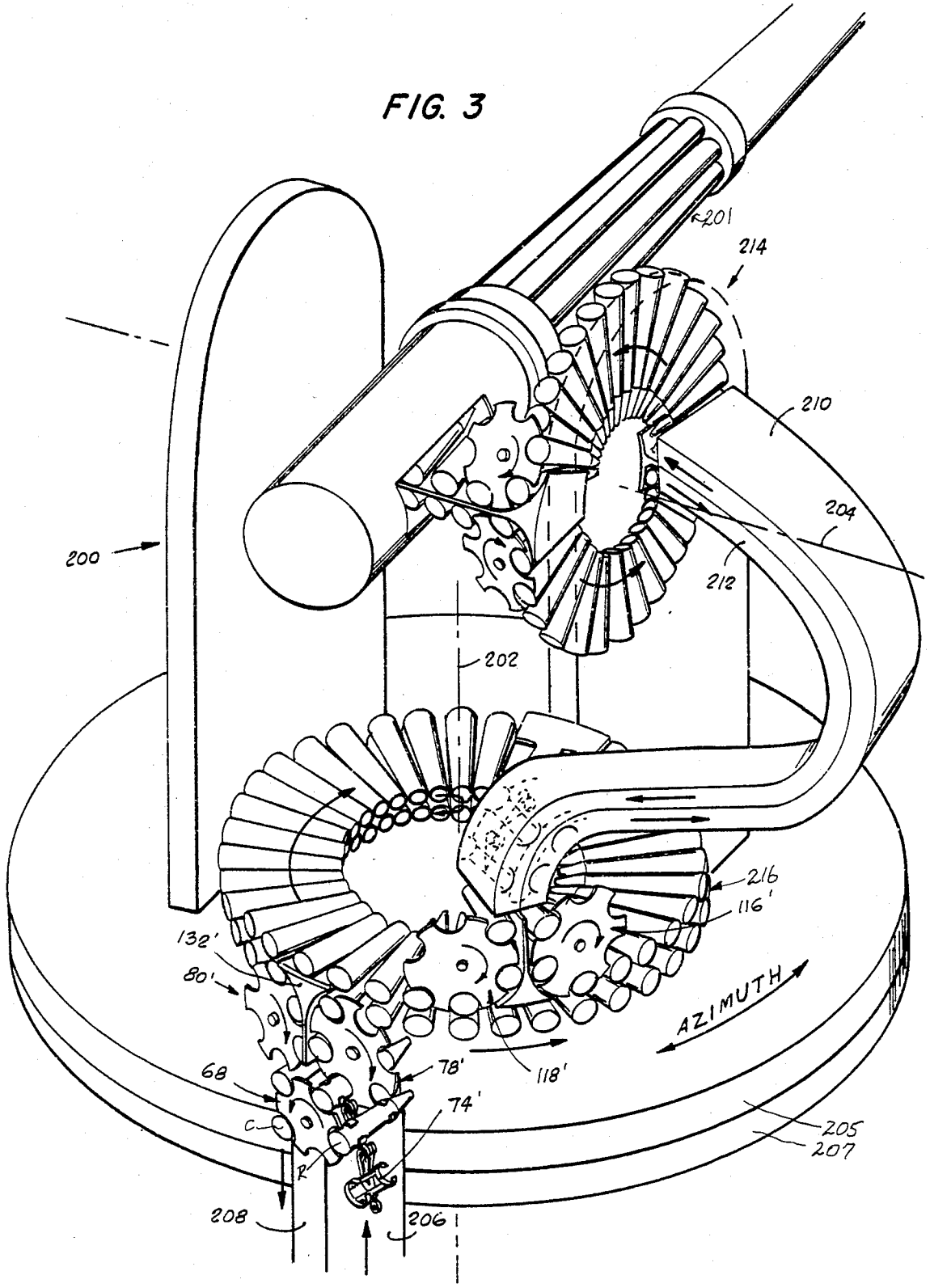
FIG. 3 is a schematic view in perspective of a turret having a single layer slip ring embodying this invention journaled for rotation about the elevation axis of the turret, and a double layer slip ring embodying this invention journaled for rotation about the azimuth axis of the turret.

FIG. 3 shows a turret 200 which has more than one full cycle of rotation about an azimuth axis 202. Ammunition is provided to the turret by a conventional, double ended drum storage system (similar to that shown in FIG. 1) by means of a live round feed conveyor run 206 and a fired cartridge case return conveyor run 208. A gun 201 is journaled to a pedestal for movement about an elevation axis 204, including displacement to the zenith. The pedestal 205 is journaled for rotation about the azimuth axis 202 to a stationary deck 207 by suitable means, not shown. Ammunition is provided to the gun by means of a live round feed conveyor run 210 and a fired cartridge case return conveyor run 212. The conveyors are coupled to the gun by a slip ring 214, which is similar to that shown in FIG. 2. The conveyors 206, 208, 210 and 212 are intercoupled by a slip ring 216 which is shown in detail in FIGS. 4 and 5.

Figure 4:
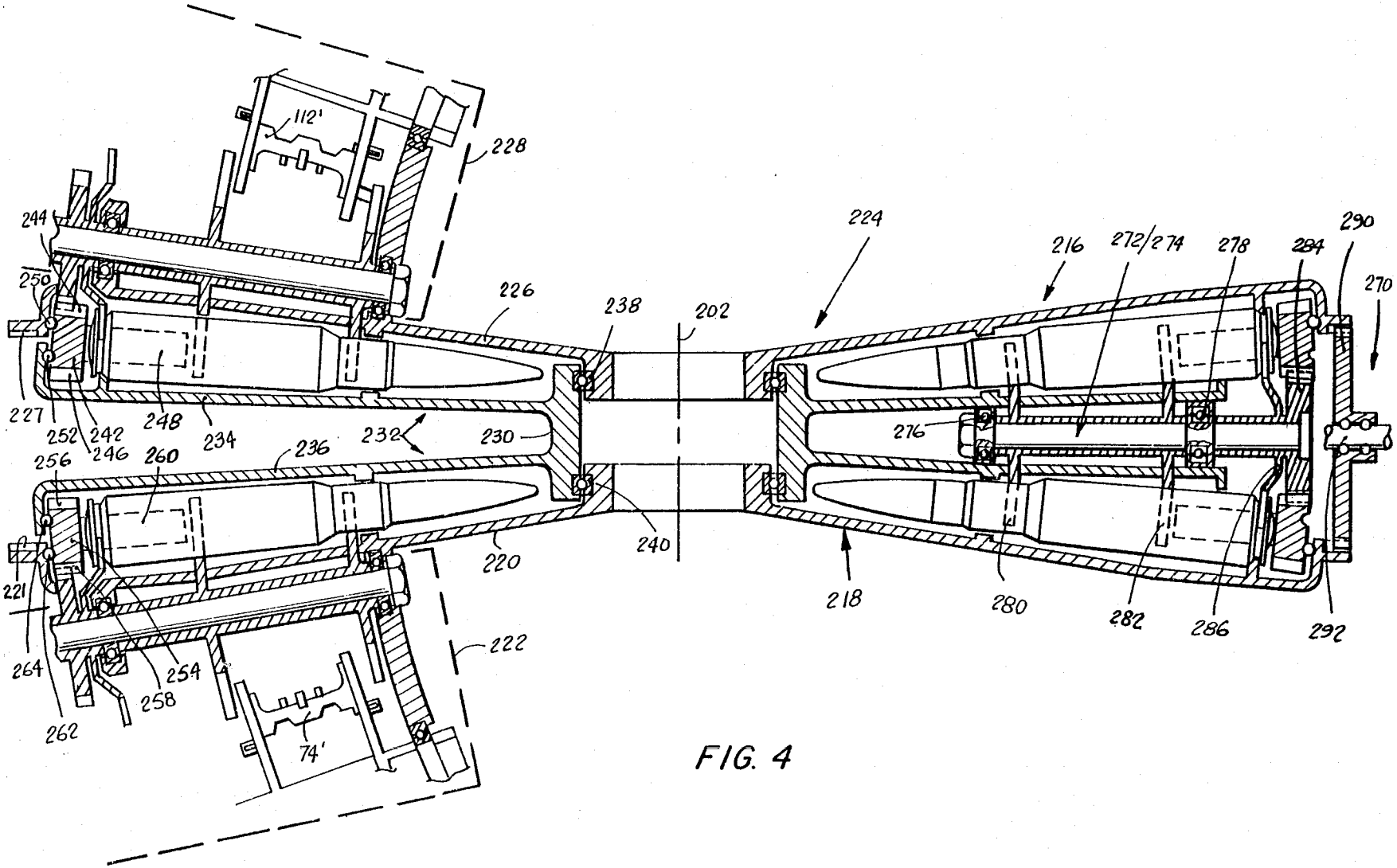
FIG. 4 is a view in elevation, taken in cross-section, of the double layer slip ring of FIG. 3.
Figure 5:
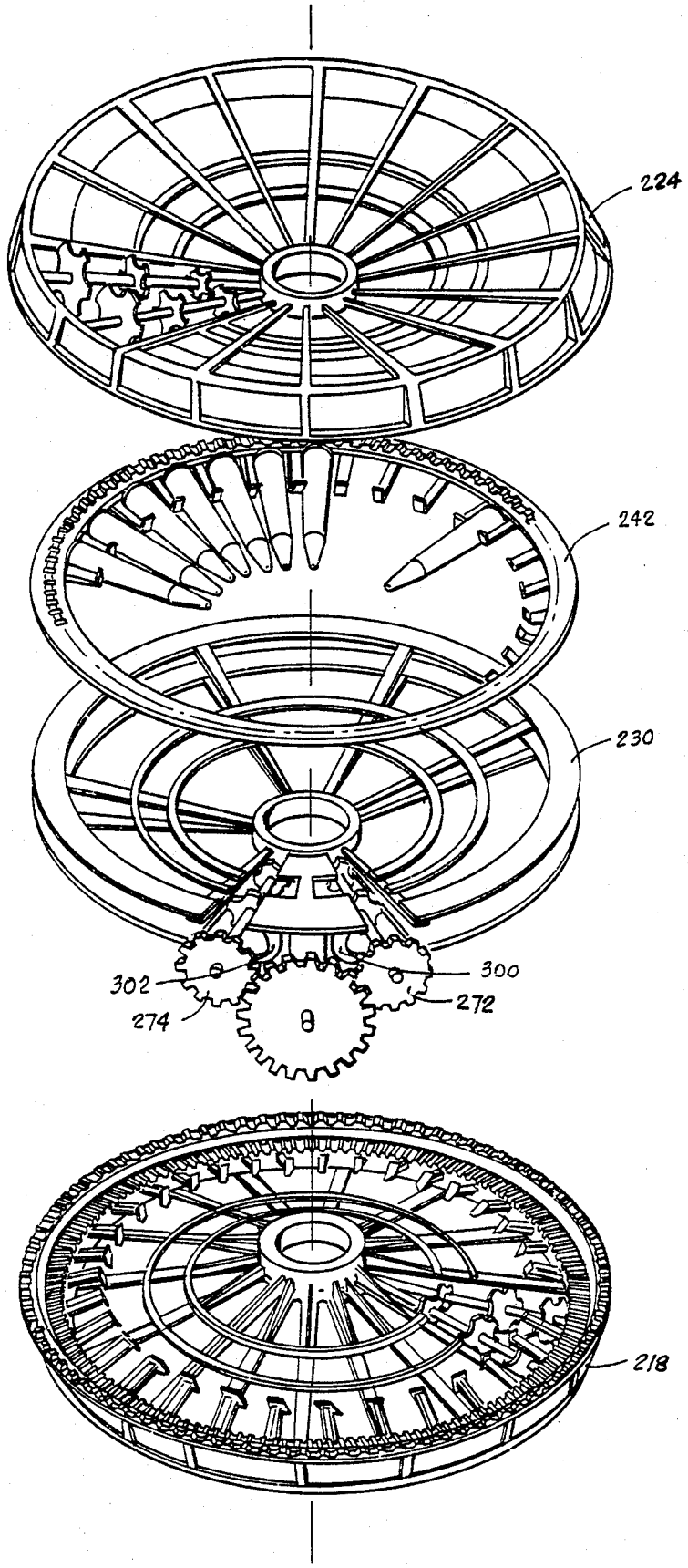
FIG. 5 is an exploded perspective view of the double layer slip ring of FIG. 4.

The slip ring 216, as shown in FIGS. 4 and 5, comprises a stationary lower group 218, including a lower cover 220, having a face gear 221, and a lower transfer unit 222; a rotating upper group 224 including an upper cover 226, having a face gear 227, which rotates in conjunction with the pedestal about the azimuth axis 202 and an upper transfer unit 228; and a differential group 230 which also rotates about the azimuth axis 202.

The differential group 230 includes an intermediate cover 232, having an upper portion 234 and a lower portion 236, and which is journaled to the upper cover 226 by a ball bearing 238 and to the lower cover 220 by a ball bearing 240. An upper retainer ring 242 having an upper face gear 244, a lower face gear 246, and a plurality of inwardly directed arms 248, with mutually adjacent pairs of arms defining a compartment for receiving a round of ammunition, is journaled by a plurality of balls 250 to the upper cover 226 and by a plurality of balls 252 to the upper intermediate cover portion 234. A lower retainer ring 254 having an upper face gear 258, a lower face gear 258, and a plurality of inwardly directed arms 260, with mutually adjacent pairs of arms defining a compartment for receiving a round of ammunition, is journaled by a plurality of balls 262 to the lower cover 220 and by a plurality of balls 264 to the lower intermediate cover portion 236.

The lower transfer unit 222 is similar to the lower transfer unit 38 described in FIG. 2 and the components thereof have similar, but primed, reference numbers.

The upper transfer unit 228 is similar to the upper transfer unit 44 described in FIG. 2 and the components thereof have similar, but primed, reference numbers.

The differential group also includes an intermediate transfer unit 270 which comprises two similar intermediate transfer conical sprockets 272 and 274, each of which is journaled by a respective inner bearing 276 and an outer bearing 278 to and between the upper and lower intermediate cover portions 234 and 236. Each sprocket, respectively, has a pair of spaced apart sprocket disks 280 and 282, which are cut out to receive the cartridge cases from the compartments of the upper and lower retaining rings, and a gear 284 which has a sprocket disk 286 which engages the extractor groove of the cartridge case. The gear 284 is meshed with both the lower face gear 246 of the upper retaining ring and the upper face gear 256 of the lower retaining ring. A gear 290 is journaled on a shaft 292 which is fixed to the differential group 230 and is meshed with both the face gear 227 of the upper cover 226 and the face gear 221 of the lower cover 220.

As best seen in FIG. 5, suitable conventional guides 300 and 302 are provided between the upper and lower intermediate cover portions in conjunction with the sprockets 272 and 274 to permit the stripping of a round or a cartridge case from a compartment in the lower retaining ring and handing it into a compartment in the upper retaining ring and vice-versa.

It will be seen that rounds R are fed into the compartments of the lower retainer ring 254 by the hand-off sprocket 78' and that fired cases C are extracted from the compartments of the lower retainer ring 254 by the hand-off sprocket 80'. Similarly, rounds R are extracted from the compartments of the upper retainer ring 242 by the hand-off sprocket 116' and fired cases are fed into the compartments by the hand-off sprocket 118'. The upper group 224, including the housing 100' and the sprockets 116' and 118', is free to rotate with respect to the lower group 218 from a disposition whereat the sprockets 116' and 118' are at one side of the sprockets 272 and 274 which in turn are at that side of the sprockets 78' and 80' through approximately 700° to a disposition whereat the sprockets 116' and 118' are at the other side of the sprockets 272 and 274 which in turn are at that other side of the sprockets 78' and 80'.

When the upper and lower groups are mutually stationary and the gun is firing, the intermediate cover portion 230 is stationary since it is held by the gear 290 on its shaft 292. The upper retainer ring 242 is rotated by the gears 128' of the sprockets 116' and 118' in one direction as the transfer unit 228 removes rounds and inserts fired cases. As the ring 242 rotates it drives, through the gears 284 of the sprockets 272 and 274, the ring 254 in the other direction. The sprocket 272 passes rounds from the lower ring to the upper ring while the sprocket 274 passes cases from the upper ring to the lower ring. As the ring 254 rotates it drives, through the gears 90' of the sprockets 78' and 80', the lower transfer unit 222 to remove fired cases from and to insert rounds into the ring 254 and the lower endless conveyor.

When the upper group rotates about the axis 202 relative to the lower group, and the gun is not firing, the endless upper conveyor of elements 112' does not advance, but causes the upper retainer ring 242 to rotate, and the upper cover 226 through the gears 244 and 290 and the shaft 292 cause the differential group 230 to rotate at one-half the rate of the cover. The rotation of the upper retainer ring causes the sprockets 272 and 274 to rotate and thereby shift rounds/case between the upper and lower retainer rings, and also causes the lower retainer ring 254 to rotate. The lower transfer unit inserts and removes rounds/cases from the lower ring and the lower endless conveyor.

When the upper group rotates due to the turret rotating about the azimuth axis 202 and the gun is firing, the upper endless conveyor is driven by the feeder of the gun and rotates the upper retainer ring 242 about the axis 202 with respect to the upper cover 226. The turret rotates the upper cover 226 about the axis 202, and, through the gear 290, rotates the differential group 230 at one-half the rate about the axis 202. The rotation of the upper retaining ring 242 causes rotation of the sprockets 272 and 274 to shift rounds and cases between the upper and lower retainer rings, and causes rotation of the lower hand-off sprockets 78 and 80 and the lower turn-around sprocket 64 to shift rounds and cases between the lower retainer ring and the lower endless conveyor.

In all cases, when rounds and cases are shifted to and from the endless conveyor, the conveyor shifts these rounds and cases to and from the double ended storage system 12.

In all cases, if the gun clears by temporarily rotating in the reverse direction, then all compartments temporarily rotate in the reverse direction.

As shown in FIG. 3, the single layer slip ring 32 described with respect to FIG. 1, may be utilized as the slip ring 214. The rotation of 340° more than accommodates any rotation in elevation, through zenith, of the gun. The more complex slip ring shown as 216 in FIG. 3 may be utilized where rotation in excess of 340° is required (usually in train).

What is claimed is:

1. A weapon system comprising:

a gun which is journaled for rotation about an axis with respect to a support;

an ammunition supply means which is stationary with respect to said support;

a differential means journaled for rotation about said axis with respect to said support and including a plurality of compartments in a circular row about said axis, each compartment for receiving a round of ammunition or a fired case;

a first ammunition transport means which is stationary with respect to said support and which is coupled to and between said supply means and said differential means;

a second ammunition transport means which is coupled to and between said gun and said differential means;

said first and second transport means serving to respectively insert or extract rounds or cases into said compartments of said differential means so that the number of compartments containing either a round or a case is constant at all relative rotational positions of said gun and said supply means.

2. A weapon system according to claim 1 wherein:

said gun drives said second ammunition transport means, which drives said differential means, which drives said first ammunition transport means, which drives said supply means.

3. A weapon system comprising:

a gun which is journaled for rotation about an axis with respect to a support;

an ammunition supply means which is stationary with respect to said support;

a slip ring assembly including a first group which is stationary;

a second group which is journaled for rotation about said axis;

a differential group disposed between said first and second groups and journaled for rotation about said axis with respect to said first and second groups;

said differential group including a plurality of compartments disposed in a circular row and journaled for rotation in a first direction and an opposite second direction about said axis, each compartment for receiving a respective article which may be either a linkless round of ammunition or a fired case, said first group including:

a first housing, a first endless conveyor having a first turn-around sprocket and a first pair of hand-off sprockets, one for passing an article from said first turn-around sprocket to said row of compartments and the other for passing an article from said row to said first turn-around sprocket when said row is rotating in said first direction, and said one for passing an article to said first turn-around sprocket from said row of compartments and said other for passing an article to said row from said first turn-around sprocket when said row is rotating in said second direction;

said second group including:

a second housing, a second endless conveyor having a second turn-around sprocket, and a second pair of hand-off sprockets for one passing an article from said second turn-around sprocket to said row of compartments and the other for passing an article from said row to said second turn-around sprocket when said row is rotating in said first direction, and said one for passing an article to said second turn-around sprocket from said row of compartments and said other for passing an article to said row from said second turn-around sprocket when said row is rotating in said second direction;

said first and second groups respectively passing articles to or from said compartments so that the number of compartments containing an article is constant at all relative rotational positions of said first, second, and differential groups.

4. A weapon system according to claim 3 wherein:

said differential group includes:

a first plurality of compartments, disposed in circular row about said axis, each compartment for receiving a respective article, a second plurality of compartments, disposed in a circular row about said axis, each compartment for receiving a respective article, means for passing articles from and to said first and second rows of compartments, means for providing relative rotation about said axis between said first and second rows of compartments, in response to relative rotation about said axis between said first and second groups; and said first pair of hand-off sprockets passing articles to and from said first row of compartments, and said second pair of hand-off sprockets passing articles to and from said second row of compartments.

5. A weapon systems according to claim 3 wherein:

said second endless conveyor drives second pair of hand-off sprockets, which drives said differential group, which drives said first pair of hand-off sprockets, which drives said first endless conveyor.

6. A slip ring for the transport of linkless ammunition and fired cases between a supply means which is stationary with respect to a support and a gun which is journaled for rotation about an axis with respect to said support, comprising:

a first transport means which is stationary with respect to said support and is adapted to be driven by the gun;

a second transport means which is journaled for rotation about said axis with respect to said support, and a differential means disposed between said first and second transport means and journaled for rotation about said axis with respect to said first and second transport means, said differential means including a plurality of compartments, each for receiving a respective round or case, said first and second transport means each respectively inserting into, or extracting rounds or cases from, said compartments, said first transport means directly coupled to and driving said differential means which is directly coupled to and drives said second transport means.

7. A slip ring for the transport of linkless ammunition between a supply means which is stationary with respect to a support, and a gun which is journaled for rotation about an axis with respect to a support, comprising:

a first group which is stationary;

a second group which is journaled for rotation about said axis;

a differential group disposed between said first and second groups and journaled for rotation about said axis with respect to said first and second groups;

said differential group including a plurality of compartments disposed in a circular row and journaled for rotation in a first direction and in an opposite second direction about said axis, each compartment for receiving a respective linkless round of ammunition, said first group including:

a first housing, a first endless conveyor having a first turn-around sprocket, and a first pair of hand-off sprockets, one for passing a linkless round of ammunition from said first turn-around sprocket to said row of compartments and the other for passing a round from said row to said first turn-around sprocket when said row is rotating in said first direction, and said one for passing a round to said first turn-around sprocket from said row and said other for passing an article to said row from said first turn-around sprocket when said row is rotating in said second direction;

said second group including:

a second housing, a second endless conveyor having a second turn-around sprocket, and a second pair of hand-off sprockets, one for passing a linkless round of ammunition between said second turn-around sprocket and said row of compartments and the other for passing a round from said row to said second turn-around sprocket when said row is rotating in said first direction, and said one for passing a round to said second turn-around sprocket from said row and said other for passing a round to said row from said second turn-around sprocket when said row is rotating in said second direction, said second endless conveyor adapted to be driven by said gun and directly coupled to and driving said second pair of hand-off sprockets, which are coupled to and drive said differential group, which is coupled to and drives said first pair of hand-off sprockets, which are coupled to and drive said second endless conveyor which is adapted to drive said supply means.

8. A slip ring according to claim 7 wherein:

said differential group includes:

a first plurality of compartments disposed in a circular row about said axis, each compartment for receiving a respective linkless round of ammunition, a second plurality of compartments disposed in a circular row about said axis, each compartment for receiving a respective linkless round of ammunition, means for passing linkless rounds of ammunition from and to said first and second rows of compartments, means for providing relative rotation about said axis between said first and second rows of compartments, in response to relative rotation about said axis between said first and second groups; and said first pair of hand-off sprockets passing linkless rounds of ammunition to and from said first row of compartments, and said second pair of hand-off sprockets passing linkless rounds of ammunition to and from said second row of compartments.

* * * * *

UNITED STATES PATENT AND TRADEMARK OFFICE

CERTIFICATE OF CORRECTION

PATENT NO. : 4,492,144

DATED : January 8, 1985

INVENTOR(S) : Joseph Dix

It is certified that error appears in the above-identified patent and that said Letters Patent are hereby corrected as shown below:

Column 2, line 35, change "jornaled" to --journaled--

Column 3, line 47, change "112" to --122--

Column 8, line 29, change "systems" to -- system --.

Signed and Sealed this

*Fourteenth* Day of *May 1985*

[SEAL]

*Attest:*

DONALD J. QUIGG

*Attesting Officer*

*Acting Commissioner of Patents and Trademarks*